United States Patent [19]

Bates

[11] 3,942,217

[45] Mar. 9, 1976

[54] CARPET CLEANING MACHINE

[76] Inventor: Jack A. Bates, 2530 Fishinger Road, Columbus, Ohio 43221

[22] Filed: May 20, 1974

[21] Appl. No.: 471,508

Related U.S. Application Data

[63] Continuation of Ser. No. 260,586, June 7, 1972, abandoned.

[52] U.S. Cl. ..... 15/321; 15/352; 15/353

[51] Int. Cl.[2] ..... A47L 7/00

[58] Field of Search ..... 15/320, 321, 352, 353; 55/342, 343

[56] References Cited

UNITED STATES PATENTS

| | | | |
|---|---|---|---|
| 2,867,231 | 1/1959 | Gerstmann | 15/353 X |
| 2,949,620 | 8/1960 | Noble | 15/321 X |
| 3,040,363 | 6/1962 | Krammes et al. | 15/320 |
| 3,063,082 | 11/1962 | Rosenberg | 15/353 X |
| 3,308,609 | 3/1967 | McCulloch | 55/342 X |
| 3,490,208 | 1/1970 | Meyer et al. | 15/353 X |
| 3,720,977 | 3/1973 | Brycki | 15/353 X |

*Primary Examiner*—Harvey C. Hornsby
*Assistant Examiner*—C. K. Moore
*Attorney, Agent, or Firm*—Palmer Fultz

[57] ABSTRACT

A carpet cleaning machine of the portable type that is characterized by a compact frame arrangement for supporting dispensing and pick-up systems for liquid type carpet cleaners. The cleaning liquid and dirty liquid are simultaneously applied to and picked up from a carpet by means of a manually operated carpet cleaning tool. The machine is further characterized by auxiliary dirty fluid collecting means mounted on a separate wheeled auxiliary frame. The auxiliary fluid collecting means is disconnectably located in the flow of dirty fluid from the carpet cleaning tool to a main collecting means on the machine with said auxiliary collecting means being adapted to be removed for emptying without preventing continuation of the carpet cleaning operation.

11 Claims, 7 Drawing Figures

FIG. 5-a

CARPET CLEANING MACHINE

REFERENCE TO CO-PENDING APPLICATION

This application is a continuation of my co-pending application Ser. No. 260,586 filed June 7, 1972, and now abandoned.

BACKGROUND OF THE INVENTION

This invention relates to carpet cleaning machines, and more particularly to a portable carpet cleaning apparatus with a novel dispensing and pick-up system for liquid type cleaning materials.

SUMMARY OF THE INVENTION

In general, the carpet cleaning machine of the present invention includes a main frame means provided with wheels which support a hydraulic dispensing system for cleaning liquids and a pneumatic pick-up system for the liquid after it has been applied to a rug, with said systems being operated simultaneously for continuous rug cleaning operations.

In accordance with the present invention the pneumatic pick-up system for the dirty cleaning fluid comprises a main dirty fluid collecting means moulded on said main frame means and connected to an auxiliary dirty fluid collecting means mounted on a separate auxiliary frame means. The picked up dirty fluid from the carpet first passes into said auxiliary collecting means, which when full, can be detatched from the system and transported on its own auxiliary wheeled frame to a disposal location. At the same time the main collecting means remains operative in the system such that one of two operators can continue the rug cleaning while the other takes the auxiliary collecting means to the disposal location.

As another aspect of the present invention, the novel carpet cleaning machine comprises a unique upright frame configuration wherein the collecting means and dispensing reservoir are compactly mounted on the upper portion of the frame means, with the other components of the dispensing and pick-up systems being compactly mounted on the frame means below said collecting means and reservoir. This provides a machine that can be moved about in confined carpeted areas, as well as one that can readily be moved up and down stairs or loaded on a vehicle bed.

As another aspect of the present invention, the carpet cleaning machine includes a novel arrangement of a collecting means and a reservoir wherein a dirty fluid collecting means is compactly mounted within a clean fluid dispensing reservoir in isolated relationship therewith.

As still another aspect of the present invention the carpet cleaning machine comprises novel auxiliary collecting means means and wheeled frame means wherein the collecting means is pivotally mounted on said frame means so as to be tiltable to facilitate emptying of the collected dirty fluid.

As still another object of the present invention the carpet cleaning machine comprises a novel upright main frame arrangement provided with an endless loading belt apparatus on the upper portion thereof which loading apparatus facilitates loading of the machine on a truck bed or the like.

It is therefore an object of the present invention to provide an improved carpet cleaning machine with a novel upright frame construction that mounts all components of the fluid dispensing and pick-up systems, including the reservoir, collecting means and in a compact and easily transported arrangement.

It is another object of the present invention to provide an improved carpet cleaning machine that includes an auxiliary dirty fluid collecting means that can be disconnected from a main collecting means for dumping with operation of the machine continuing with dirty fluid picked up being delivered to a main fluid collecting means.

It is another object of the present invention to provide an improved carpet cleaning machinee that includes a novel integrated arrangement of both the fluid dispensing reservoir and fluid collecting means.

It is another object of the present invention to provide an improved carpet cleaning machine that includes a novel auxiliary collecting means apparatus that can be readily transported and dumped on its own auxiliary frame.

It is still another object of the present invention to provide an improved carpet cleaning machine that includes a novel loading means for facilitating the loading and unloading of the machine on a truck bed or the like. Such loading means permits the machine to be laid down and moved onto the bed of a small pick-up truck or station wagon thereby eliminating the need for a large truck with high head room.

Further objects and advantages of the present invention will be apparent from the following description, reference being had to the accompanying drawings wherein a preferred form of embodiment of the invention is clearly shown.

BRIEF DESCRIPTION OF THE DRAWINGS

FIG. 5-A is a partial top elevational view corresponding to FIG. 5; and

DESCRIPTION OF THE PREFERRED EMBODIMENT

Figure 1:
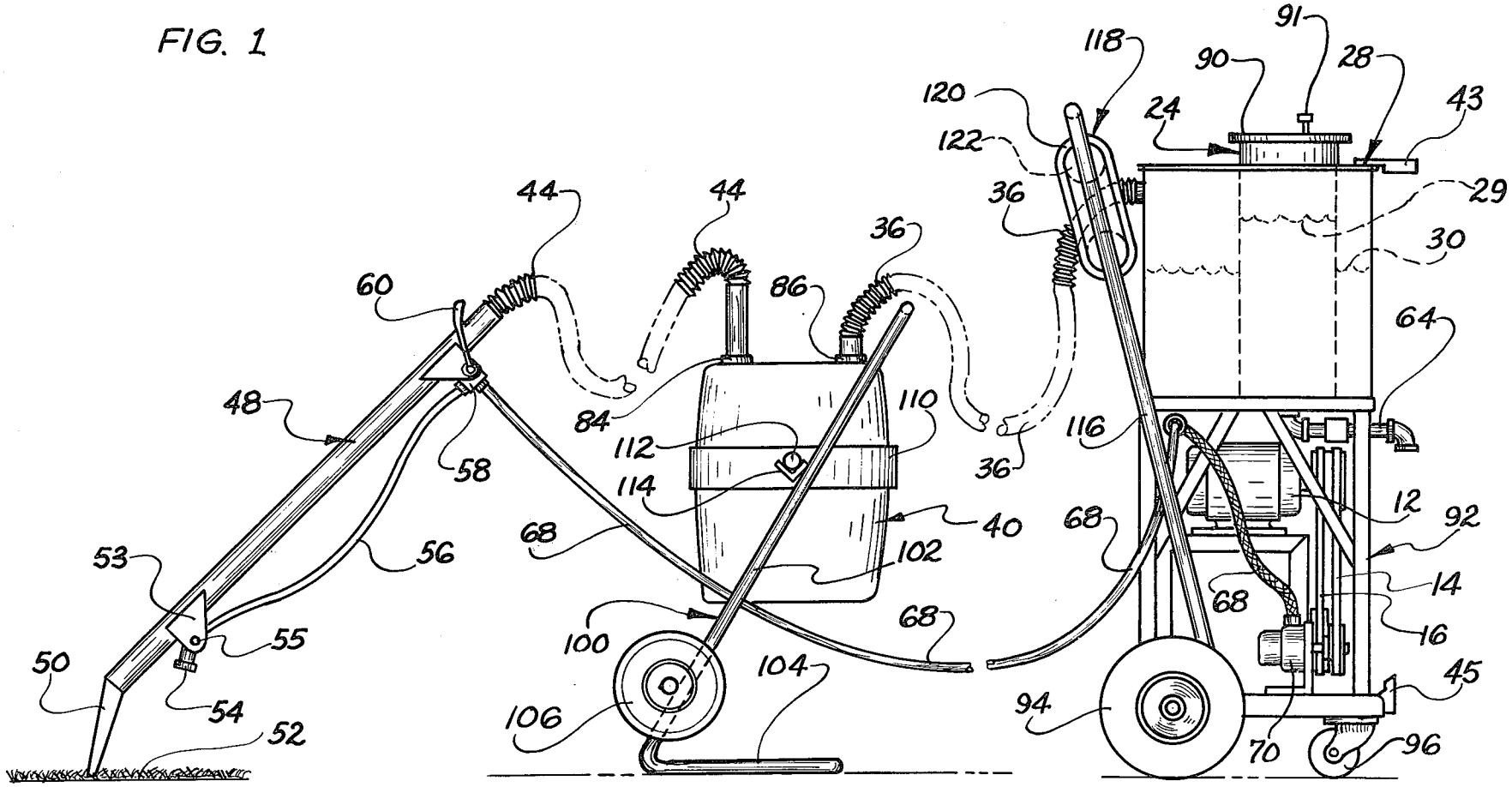
FIG. 1 is a side elevational view of the carpet cleaning machine constructed in accordance with the present invention.
Figure 2:
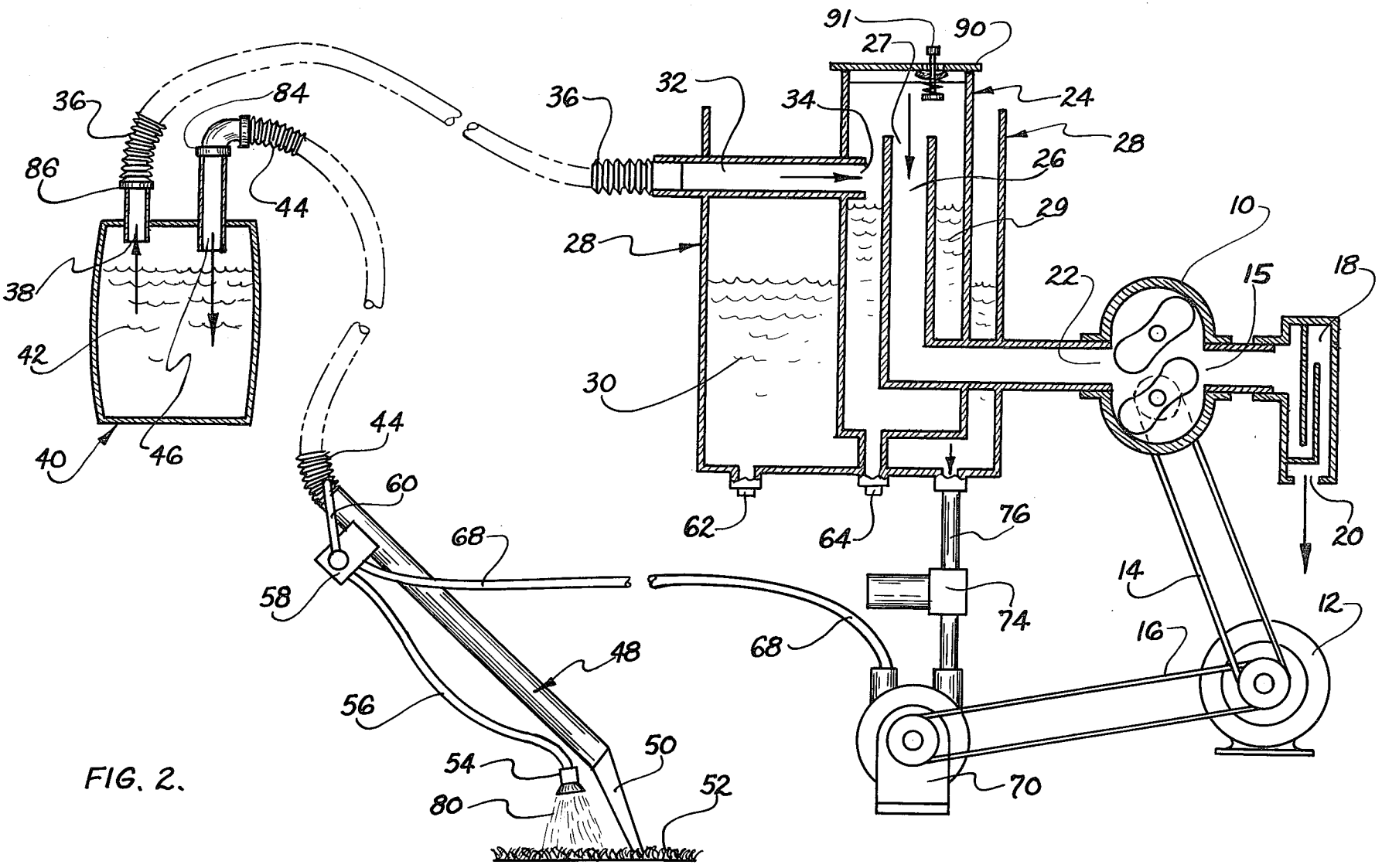
FIG. 2 is a diagrammatic view illustrating the fluid dispensing and fluid collecting systems of the machine of FIG. 1.
Figure 3:
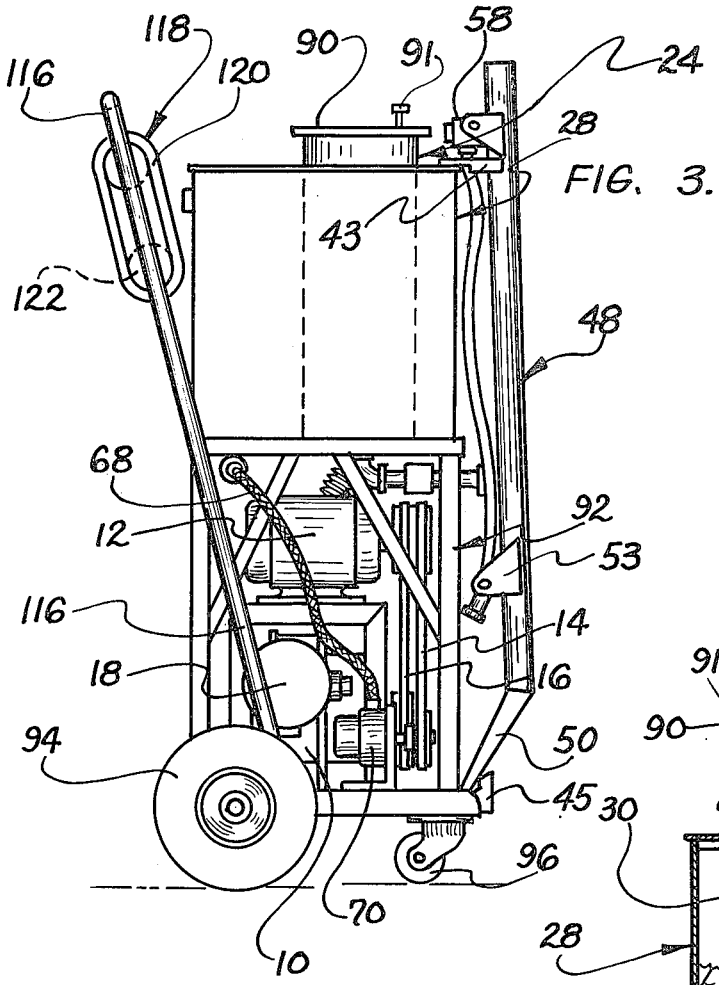
FIG. 3 is a right side elevational view of the machine of FIG. 1.
Figure 4:
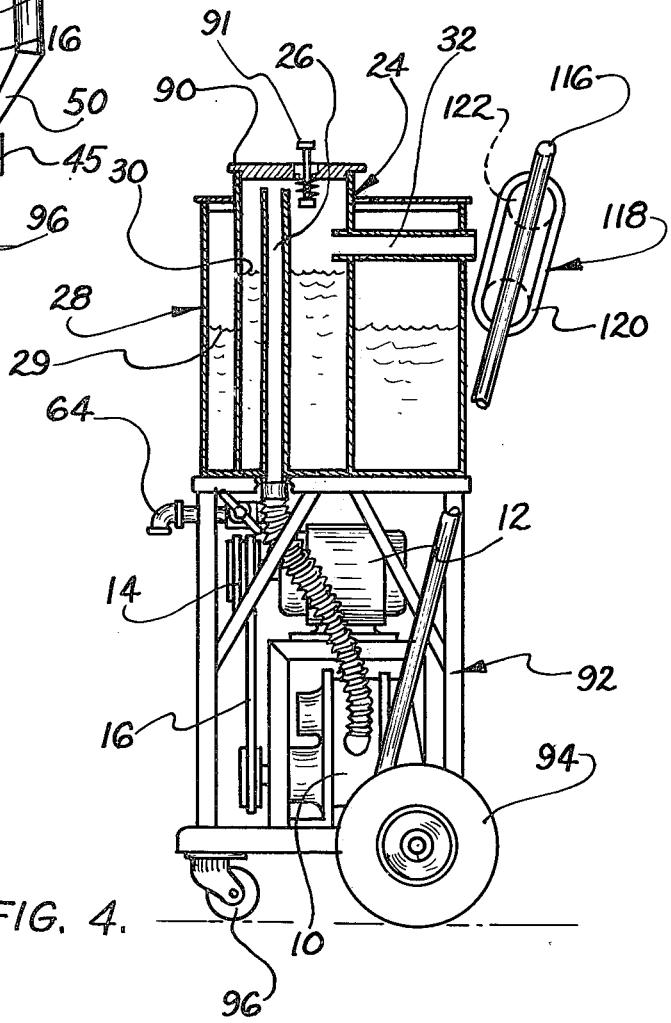
FIG. 4 is a left side elevational view of the machine of FIG. 1.
Figure 5:
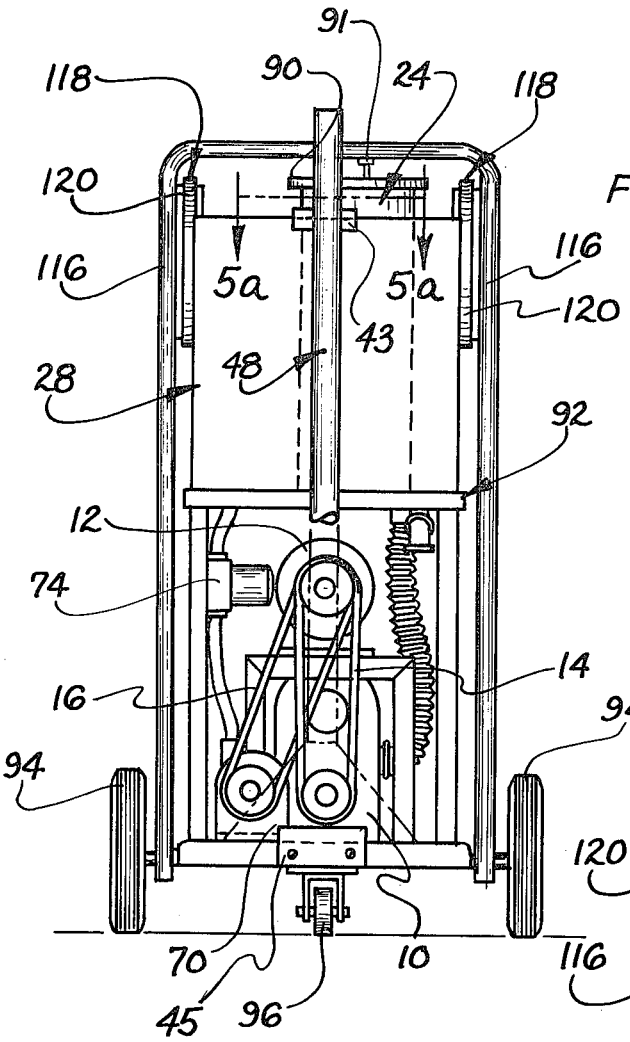
FIG. 5 is a rear elevational view of the machine of FIG. 1.
Figure 6:
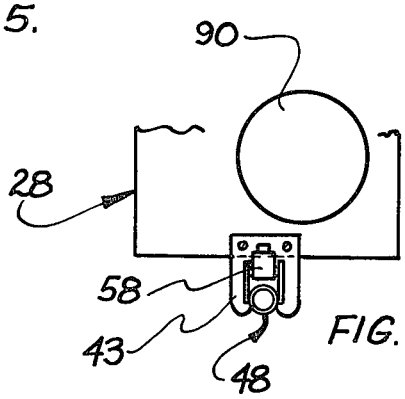
FIG. 6 is a front elevational view of the machine of FIG. 1.
Figure 6:
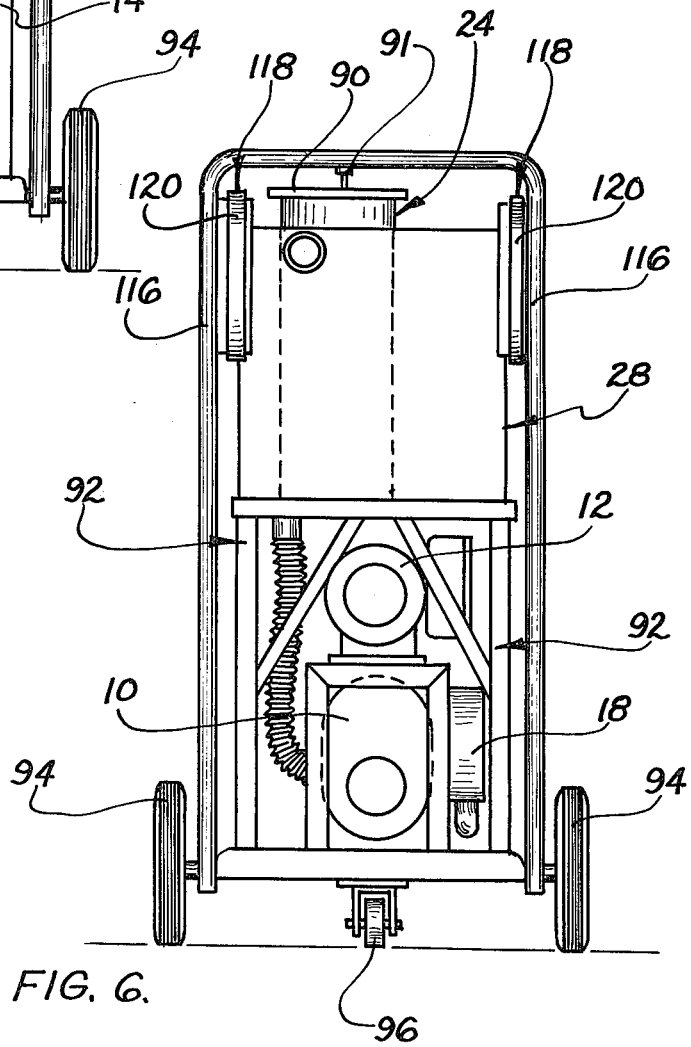

Referring to FIGS. 1 and 2, the machine of the present invention comprises a main frame 92 that supports a cleaning fluid dispensing reservoir 28 mounted on the upper portion thereof. A main dirty fluid collecting means is mounted within dispensing reservoir 28 in isolated relationship therewith as is best seen in FIG. 2.

A manipulatable carpet cleaning tool is indicated generally at 48 and includes a dirty fluid pick-up opening 50 that is moved along the carpet by the operator. Suction is provided at inlet opening 50 by a blower 10 which includes a blower inlet 22 that sucks air from inlet 50 through the handle, a flexible hose 44, and auxiliary collecting means 40, a flexible hose 36, a horizontal tube 32, the interior of a secondary dirty fluid collecting means 24, and L-shaped tube 26 communicating with the blower inlet.

As is best seen in FIG. 2, air is discharged from the outlet of blower 10 via pipe 15 and muffler trap 18 to the environment at 20.

It should be mentioned that the dirty fluid is deposited in dirty bath 42 of auxiliary collecting means 40 until such collecting means fills to the level of vertical tube outlet 38 at which time fluid will be carried over into a main dirty bath 29 in main collecting means 24. It should be mentioned that the vertical tube and outlet 38 is transparent and can be vertically adjusted by the operator so as to establish the extent of filling of collecting means 40. The fact that such pipe is transparent provides a visual indicator for the operator as to when collecting means 40 must be emptied. At this time the auxiliary collecting means 40 can be disconnected and the carpet cleaning tool connected directly to horizontal pipe 32 via couplings 84 and 86 so as to continue operation of the machine while the auxiliary collecting means is being transported and emptied.

It should be mentioned that main collecting means 24 is provided with a vacuum relief valve 91 mounted in a lid 90 thereof so as to admit ambient air at some predetermined pressure setting of vacuum relief valve 91.

With continued reference to FIGS. 1 and 2, main frame 92 further includes a cleaning fluid dispensing reservoir 28 mounted on the upper portion thereof and containing a bath 30 of cleaning fluid to be applied to the carpet. Such fluid is delivered to a spray outlet 54 on the wand means 48 via reservoir outlet 76, valve 74, pump 70, flexible hose 68, dispensing flow control valve 58 and flexible hose 56 connected with the outlet nozzle 54.

It should further be mentioned that carpet cleaning tool 48 can conveniently be stored on the machine by placing the lower pick-up opening 50 on the base means behind a retaining bracket 45 and by also removably inserting the upper portion of the carpet cleaning tool 48 into a resilient bracket 43 formed of synthetic rubber or the like that permits the carpet cleaning tool to be attached to the machine.

It will now be understood that when the operator opens control valve 60, a spray 80 of cleaning fluid will be delivered directly to carpet 52.

A motor 12 is mounted on the frame means beneath the cleaning fluid reservoirs and main collecting means and arranged to drive blower 10 by a flexible belt 14, as well as pump 70 by a flexible belt 72.

It should be mentioned that main frame 92 is provided with spaced rear wheels 94 and a front caster wheel 96 as well as with upright handle members 16 which permit manipulation of the machine within confined carpetted areas such as hallways or the like.

With further reference to main frame 92, the upper portion of handle means 116 includes a rotary loading means 118 in the form of an endless rubber belt 120 mounted on pulleys 122. Such loading means 118 greatly facilitates the mounting of the machine on a truck bed merely by tilting the machine until the belt 120 engages the end of the truck bed and by further lifting the lower end of the machine to a horizontal position wherein it can be rolled back onto the truck bed.

It should be mentioned that drains 62 and 64 are provided for cleaning fluid reservoir 28 and main collecting means 24.

With reference to FIG. 1, auxiliary frame 100 includes a generally tubular frame comprising a supporting base 104 provided with spaced front wheels 106 for transporting the auxiliary frame 100 when tilted and wheeled. Inclined tubular handle members 102 each includes a cradle 114 that pivotally supports bearing rods 112 mounted to a band 110 surrounding auxiliary collecting means 40.

In operation, when auxiliary collecting means 40 becomes full the operator merely turns off motor 12 and then disconnects flexible tubes 44 and 36 from reservoir 40 at the couplings 84 and 86. The flexible tubes 44 and 36 can then be connected together at coupling 84 and 86 and motor 12 restarted so that the operator can continue the carpet cleaning operation while his helper wheels auxiliary frame means 100 to the disposal location where it can be tilted and dumped.

As an alternative when auxiliary collecting means 40 becomes full it can be removed and immediately replaced with an identical spare collecting means so that the carpet cleaning operation can continue while the full reservoir is being emptied.

While the form of embodiment herein shown and described constitutes preferred forms, it is to be understood that other forms might be adopted falling within the scope of the claims that follow:

What is claimed is:

1. A carpet cleaning machine comprising, in combination, wheeled frame means; a cleaning fluid reservoir mounted on the upper portion of said frame means and including a cleaning fluid reservoir outlet; a dirty fluid collecting means on the upper portion of said frame means and including a collecting means inlet and outlet; blower means mounted on said frame means below said collecting means and including a blower inlet communicating with said outlet of said dirty fluid collecting means and a blower outlet communicating with the environment; pump means mounted below said reservoir means and including a pump including a pump inlet communicating with said cleaning fluid reservoir outlet and a pump outlet; a manually manipulatable carpet cleaning tool including a tool outlet for dispensing said cleaning fluid and a tool inlet for collecting dirty fluid; passage means for delivering said cleaning fluid from said pump outlet to said tool outlet; second passage means for delivering said dirty fluid from said tool inlet to said collecting means inlet; motor means mounted on said frame means for driving said blower means and pump means; and rotary loading means on the upper portion of said frame means for supporting the top of the machine when loading said machine on a truck bed or the like.

2. The carpet cleaning machine defined in claim 1 wherein said frame means includes laterally spaced wheels, a supporting base, and a handle means for manipulating said machine on said wheels upon tilting of said frame means.

3. The carpet cleaning machine defined in claim 1 wherein said dirty fluid collecting means is mounted within said cleaning fluid reservoir.

4. The carpet cleaning machine defined in claim 1 that includes an auxiliary dirty fluid collecting means separate from said first dirty fluid collecting means and disconnectably interposed in said second passage means.

5. The carpet cleaning machine defined in claim 4 that includes an auxiliary wheeled frame means removably supporting said auxiliary dirty fluid collecting means.

6. The carpet cleaning machine defined in claim 1 further including an auxiliary wheeled frame means; and an auxiliary dirty fluid collecting means pivotally mounted on said auxiliary frame means and means removably connecting said collecting means in said second passage means.

7. A carpet cleaning machine comprising, in combination, main frame means; a cleaning fluid reservoir mounted on said main frame means and including a cleaning fluid reservoir outlet; a main dirty fluid collecting means on said main frame means and including a main collecting means inlet and a main collecting means outlet; blower means mounted on said main frame means and including a blower inlet communicating with said main collecting means outlet and a blower outlet communicating with the environment; pump means including a pump inlet communicating with said cleaning fluid reservoir outlet and a pump outlet; motor means mounted on said main frame means for driving said blower means and pump means; an auxiliary wheeled frame means; an auxiliary dirty fluid collecting means mounted on said auxiliary frame means and including an auxiliary collecting means inlet and an auxiliary collecting means outlet; a manually manipulatable carpet cleaning tool including a tool outlet for dispensing said cleaning fluid and a tool inlet for collecting dirty fluid; passage means for connecting said pump outlet to said tool outlet; second passage means for delivering said dirty fluid from said tool inlet to said auxiliary collecting means inlet; and third passage means connecting said auxiliary collecting means outlet to said main collecting means inlet, said second and third passage means being disconnectable with respect to said auxiliary reservoir so said auxiliary reservoir can be independently transported on said wheeled frame to a dirty fluid disposal location, said second and third passage means being connectable to allow continued functioning of the apparatus by direct delivery of dirty fluid to the main dirty fluid collecting means.

8. The carpet cleaning machine defined in claim 7 wherein said main frame means includes laterally spaced wheels, a supporting base, and a handle means for manipulating said machine on said wheels upon tilting of said main frame means.

9. A carpet cleaning machine comprising, in combination, main frame means; a cleaning fluid reservoir mounted on said main frame means and including a cleaning fluid reservoir outlet; a main dirty fluid collecting means on said main frame means and including a main collecting means inlet and a main collecting means outlet; blower means mounted on said main frame means and including a blower inlet communicating with said main collecting means outlet and a blower outlet communicating with the environment; pump means including a pump inlet communicating with said cleaning fluid reservoir outlet and a pump outlet; motor means mounted on said main frame means for driving said blower means and pump means; an auxiliary wheeled frame means; an auxiliary dirty fluid collecting means mounted on said auxiliary frame means and including an auxiliary collecting means inlet and an auxiliary collecting means outlet; a manually manipulatable carpet cleaning tool including a tool outlet for dispensing said cleaning fluid and a tool inlet for collecting dirty fluid; passage means for connecting said pump outlet to said tool outlet; second passage means for delivering said dirty fluid from said tool inlet to said auxiliary collecting means inlet; third passage means connecting said auxiliary collecting means outlet to said main collecting means inlet, said second and third passage means being disconnectable with respect to said auxiliary reservoir so said auxiliary reservoir can be independently transported on said wheeled frame to a dirty fluid disposal location; and an endless loading belt mounted on the upper portion of the machine for supporting the top of the machine when loading said machine on a truck bed or the like.

10. The carpet cleaning machine defined in claim 7 wherein said main dirty fluid collecting means is mounted within said cleaning fluid reservoir.

11. The carpet cleaning machine defined in claim 7 wherein said auxiliary dirty fluid collecting reservoir is pivotally mounted on said auxiliary frame means.

* * * * *